US007339138B1

(12) United States Patent
Brooks

(10) Patent No.: US 7,339,138 B1
(45) Date of Patent: Mar. 4, 2008

(54) FOLDABLE OVEN RACK

(76) Inventor: Jean Gillis Brooks, 4-3890 Kencrest Avenue, Halifax (CA) B3K 3L6

( * ) Notice: Subject to any disclaimer, the term of this patent is extended or adjusted under 35 U.S.C. 154(b) by 0 days.

(21) Appl. No.: 11/470,644

(22) Filed: Sep. 7, 2006

(51) Int. Cl.
*A21B 1/00* (2006.01)

(52) U.S. Cl. ..... 219/392; 219/732; 219/763; 99/426; 99/449; 99/450; 126/9 R; 126/30

(58) Field of Classification Search ..... 219/732, 219/763; 99/426, 449, 450; 126/9 R, 30; 248/166, 172

See application file for complete search history.

(56) References Cited

U.S. PATENT DOCUMENTS 6,164,194 A * 12/2000 Westmoreland ..... 99/426
2006/0102163 A1* 5/2006 Sanders et al. ..... 126/30

* cited by examiner

*Primary Examiner*—Tu Ba Hoang
*Assistant Examiner*—Leonid Fastovsky
(74) *Attorney, Agent, or Firm*—Schmeiser, Olsen & Watts

(57) ABSTRACT

A supporting rack includes arranged rods arranged to form a planar grid pattern and connection device to allow for modification in the overall space occupied by the rack. In a preferred embodiment, a rack for use in a conventional domestic cooking oven is formed of perpendicularly disposed rods of material such as stainless steel suitable for withstanding the temperatures to which such an oven may be subjected and has an outer frame capable of interfacing with support inside oven walls, and generally centrally disposed hinged mechanism to allow folding of the portions of the rack to reduce its size and facilitate handling when performing tasks such as cleaning the rack.

15 Claims, 2 Drawing Sheets

FOLDABLE OVEN RACK

The present invention relates generally to an oven rack apparatus purposed to support food or containers of food while cooking in a conventional domestic oven. While the focus of discussion will be on a domestic oven, it should be clear that the apparatus and its use should not be restricted thereto. It can easily be envisioned that a rack as will be disclosed herein can be used for a number of other purposes. Examples of such, are outdoor barbeque grilling surface over a gas element or charcoal, indoor grilling surfaces, and baker's cooling racks.

The design and use of an oven rack in domestic ovens is well taught and documented in the art. Traditionally, the typical cleaning of such racks is difficult due to their rigid design and large overall size. Such cleaning whether effected indoors or outdoors, usually requires the use of a bathtub or suitably sized basin, to allow for complete submersion and proper cleaning.

DESCRIPTION OF THE PRIOR ART

Numerous oven racks of varying structures are known and form part of the prior art which support food and food containers inside domestic cooking ovens. In most cases, the racks are comprised of a stainless steel material arranged in a perpendicular grid fashion, and are rigid in their design. An example of a convention rack can be found in U.S. Pat. No. 6,112,916 dated Sep. 5, 2000 and entitled "Oven Rack" in which the entire frame is rigid and non-configurable and the rack is slid into and out of the oven in its fixed configuration.

U.S. Pat. No. 6,349,717 dated Feb. 26, 2002 and entitled "Oven Rack System Having Cutout Area and Insert Rack" and Canadian Patent No. 702309 dated Jan. 19, 1965 and entitled "Dual Purpose Oven Rack" teach variations of the conventional rack in which portions of the rack can be removed. However, unlike the invention taught herein, the intended purpose of these inventions is to allow flexible placement of food items in the oven cavity that may exceed the height allowed when using a one-piece rigid frame. In each of these inventions, the outer frame is still rigid and would ultimately remain difficult to handle outside the oven cavity.

U.S. Pat. No. 4,553,523 dated Nov. 19, 1985 and entitled "Two-Way Adjustable Grate and Method for Adjusting the Length and Width" and U.S. Pat. No. 6,148,813 dated Nov. 21, 2000 and entitled "Telescoping Oven Rack Assembly" disclose oven rack designs allowing configurable shapes. The former provides a rack capable of compression and extension in the plane, but is limited by the predefined size of each of the two components of the rack. The latter provides a telescoping component of the base rack for sliding outward of the oven cavity while the main rack remains in place. Neither the telescoping component nor the base component are substantially different in size and neither will fit in a standard kitchen sink or similar container for convenient cleaning and washing. Accordingly, there is a need to provide a supporting rack having a hinge assembly, such as to ensure ready foldability through the hinge assembly, whereby it may be readily and conveniently submersed in a standard kitchen sink or alternative washing or cleaning vehicle to facilitate cleaning of unwanted material from the supporting rack.

SUMMARY OF THE INVENTION

Thus, a primary object of the present invention is to provide a planar supporting surface comprising connection means adapted to allow connection of the planar surface with at least one other similar planar surface to form a unitary planar surface for supporting food or food containers. The connection means may take the form of a suitably structured hinge assembly, such as to ensure ready foldability through the hinged connection, whereby it may be readily and conveniently submersed in a standard kitchen sink or alternative washing or cleaning vehicle to facilitate cleaning of unwanted material from the supporting surface. The unitary planar supporting surface is adapted to be removably inserted into a cooking oven, and held in place therein. The area of the unitary planar supporting surface is of substantially the same area as a sum of areas of the planar surface and said at least one other similar surface.

According to one aspect of the present invention, there is provided a supporting rack, comprising a planar surface comprising a first and a second portion; connection means adapted to allow the first and the second portion to be folded about said connection means to reduce the overall space occupied by the rack and to facilitate handling and storage of the rack, or to form a unitary planar supporting surface for supporting food or food containers; wherein said unitary planar supporting surface is adapted to be removably inserted into a cooking device, and maintained therein; and wherein said connection means further comprises a support member, the support member being connected at one end to a bottom portion of the first portion of the planar supporting surface, and pivotally connected at another end to a plate portion, the plate portion being integrally connected underneath a bottom portion of the second portion of the planar supporting surface, whereby the first portion of the planar supporting surface can be pivoted downwardly, so as enable the supporting rack to be folded.

According to another aspect of the present invention, there is provided a supporting rack for supporting food or food containers comprising a first surface portion and a second surface portion; connection means adapted to allow the first surface portion and the second surface portion to be folded about the connection means to reduce overall space occupied by the rack so as to facilitate handling and storage thereof and to form a unitary substantially planar surface for supporting the food or food containers; wherein the planar supporting surface is adapted to be removably inserted into a cooking device; and wherein the connection means comprises a downwardly depending support member, the support member being connected at one end to a bottom portion of the first surface portion, and pivotally connected at another end to a plate portion, the plate portion being integrally connected to a bottom portion of the second surface portion by a bracing member interconnected therebetween, whereby the first surface portion can be pivoted downwardly, so as to enable the supporting rack to be folded and whereby upward pivoting movement of the first surface portion is restricted by a downwardly depending rest member which is connected underneath the second surface portion.

The present invention contemplates and teaches the provision of a rack suitable for use in a domestic oven, or the like, which comprises a unitary surface embodying a plurality of rack-like supporting surfaces of convenient structure and dimensions such as to ensure ready foldability through hinged connection. The rack may assume varying shapes in practice including rectangular, quadrilateral, circular, elliptical, a rack with rounded corners and perhaps others, providing the structural feature of the inclusion of a hinged connection to enable ready folding of one larger rack surface into two smaller surfaces to facilitate cleaning thereof.

In a preferred embodiment the rack of the present invention preferably includes rods comprised of stainless steel materials. Alternatively, the rack may include rods comprising aluminum alloys capable of withstanding heat normally developed in a domestic oven or other such heated equipment.

The rack of the present invention preferably includes a plurality of rods arranged in perpendicular disposition.

However, rack structures falling within the scope of the present invention embodying rods of non-perpendicular disposition may also be found workable in practice providing the overall structure includes the feature of a secure, hinged connection to ensure foldability of one larger planar rack surface into two smaller surfaces. The rack of the present invention preferably includes a hinged mechanism whereby, in one preferred structure, the hinged connection includes a support member connected at one end to a bottom portion of a first half of the outer frame. At another end of the support member, the support member is pivotally connected to plate portion, whereby the first half of the outer frame can be pivoted downwardly, so as enable the oven rack to be folded into half of its usual length. Upward pivoting movement of the first half of the outer frame is restricted by a rest member provided on a second half of the outer frame.

The rack of the present invention is preferably structured so that in use the, at least two smaller portions of the rack, may be readily and conveniently submersed in a standard kitchen sink or alternative washing or cleaning vehicle to facilitate cleaning of unwanted material from the rack.

The rack of the present invention is preferably and indeed normally used in practice to support food or food containers inside a domestic cooking oven. It is also envisioned that the rack of the present invention may be used to support food or food containers on an outdoor cooking grill comprising a heat source of any one of gas, charcoal or the like. In addition, the rack may be used to support food or food containers to allow for proper ventilation in the normal cooling process.

BRIEF DESCRIPTION OF THE DRAWINGS

Embodiments of the present invention will be further described with reference to the accompanying drawings, in which.

DETAILED DESCRIPTION OF THE DRAWINGS

Figure 1:
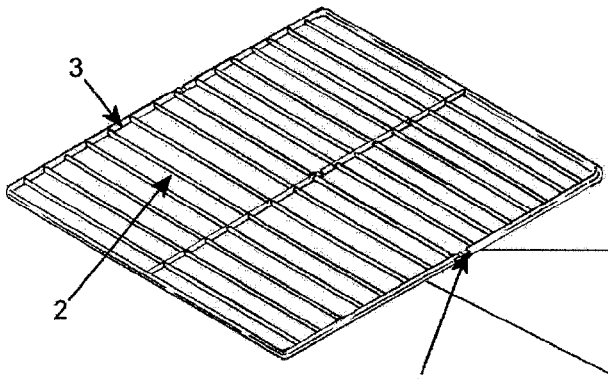
FIG. 1 is a perspective view of an embodiment of the oven rack of the present invention.
Figure 2:
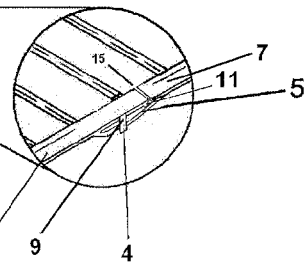
FIG. 2 is a perspective view of a hinged mechanism allowing separation of the halves of the rack in accordance with the present invention.
Figure 4:
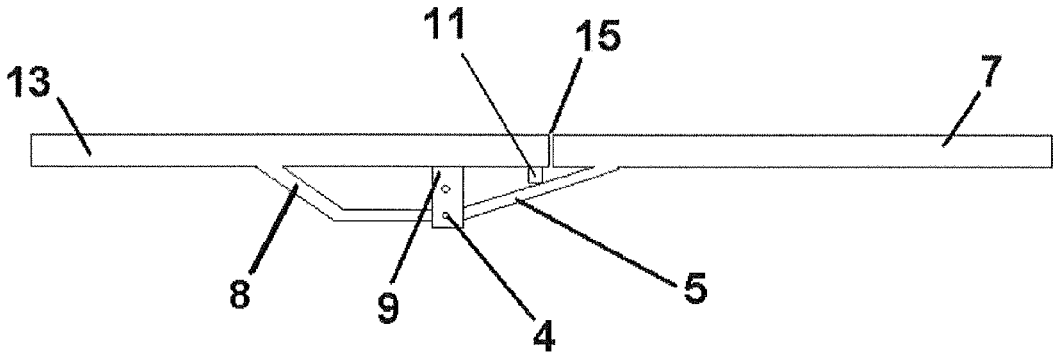
FIG. 4 is a blown up side view of the hinged mechanism of FIGS. 2 and 3.

FIG. 1 shows an exemplary embodiment of the oven rack of the present invention. As can be seen in FIG. 2, the oven rack comprises a pivotally connected first half 7 of the outer frame and a second half 13 of the outer frame, the frame forming a unitary planar supporting surface adapted to be removably inserted into a cooking device, it being understood that cooking device can be a domestic or commercial cooking oven, an outdoor grilling device, or the like. It will also be understood that such frame can be adapted to interface with supporting slots provided along inner walls of an oven cavity, for example, or to interface with supporting slots provided along inner walls of a grilling device. With reference again to FIG. 1, the oven rack comprises an outside frame 3, cross rods 2, and a joining mechanism 1. The outside frame 3 is a rectangular shape with rounded corners containing a centrally located rod parallel to the longer sides of the rectangle. Each of these three rods are divided near their centre to allow for the joining mechanism 1. Cross rods 2 extend perpendicularly from the three longer rods, connecting the centre rod to each of the outside rods, resulting in a grid pattern.

Figure 3:
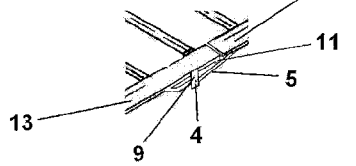
FIG. 3 is a further perspective view of a hinged mechanism allowing separation of the halves of the rack in accordance with the present invention.

FIG. 2 and FIG. 3 show an amplified view of the joining mechanism 1 in which the mechanics of the joint are evident. It is shown that the joining mechanism 1 is made up of a support member 5 connected at one end to a bottom portion of a first half 7 of the outer frame. Preferably, support member 5 is welded onto the bottom portion of a first half 7 of the outer frame. At another end of the support member 5, the support member is pivotally connected 4 to plate portion 9, and the plate portion 9 is integrally interconnected to a bottom portion of the second half 13 of the outer frame by means of a bracing member 8 positioned therebetween, whereby the first half 7 of the outer frame can be pivoted downwardly, so as enable the oven rack to be folded into half of its usual length. Upward pivoting movement of the first half 7 of the outer frame is restricted by a downwardly depending rest member 11 on a second half 13 of the outer frame.

Of course, it will be understood that the first half 7 of the outer frame and the second half 13 of the outer frame will preferably be substantially similar in size, but one skilled in the art will appreciate that these could be of different sizes also.

In a preferred embodiment, rest member 11 is welded onto a lower portion of the second half 13 of the outer frame, and near where the separation point 15 is between the first half 7 and the second half 13 of the outer frame. In this manner, preferably, when the first half 7 of the outer frame is pivoted upwardly, so that the oven rack of the present invention is to assume its full, complete length, rest member 11 restricts this upward pivoting movement of the first half 7 of the outer frame so that it assumes a substantially horizontal position with and in relation to the second half 13 of the outer frame.

The embodiments of the invention in which an exclusive property or privilege is claimed are defined as follows:

1. A supporting rack for supporting food or food containers comprising:

a first surface portion and a second surface portion;

connection means adapted to allow the first surface portion and the second surface portion to be folded about the connection means to reduce overall space occupied by the rack so as to facilitate handling and storage thereof and to form a unitary substantially planar supporting surface for supporting the food or food containers;

wherein the planar supporting surface is adapted to be removably inserted into a cooking device; and wherein the connection means comprises a downwardly depending support member, the support member being connected at one end to a bottom portion of the first surface portion, and pivotally connected at another end to a plate portion, the plate portion being integrally connected to a bottom portion of the second surface portion by a bracing member interconnected therebetween, whereby the first surface portion can be pivoted downwardly, so as enable the supporting rack to be folded and whereby upward pivoting movement of the first surface portion is restricted by a downwardly depending rest member which is connected underneath the second surface portion.

2. The supporting rack according to claim 1, wherein the first surface portion and the second surface portions are substantially similar in size.

3. The supporting rack according to claim 1, wherein the first surface portion and the second surface portions are of different sizes.

4. The supporting rack according to claim 1, wherein the supporting rack comprises a plurality of portions mutually interconnected and adapted to be mutually foldable.

5. The supporting rack according to claim 1, wherein the cooking device is a domestic or commercial cooking oven having inner walls.

6. The supporting rack according to claim 1, wherein the cooking device is an outdoor grilling device having inner walls.

7. A supporting rack according to claim 5, comprising an outer frame adapted to interface with supporting slots provided along the inner walls.

8. A supporting rack according to claim 6, comprising an outer frame adapted to interface with supporting slots provided along the inner walls.

9. A supporting rack according to claim 1, having an overall quadrilateral or rectangular shape.

10. A supporting rack according to claim 9, having rounded corners.

11. A supporting rack according to claim 1, having an overall circular or elliptical shape.

12. A supporting rack according to claim 1, wherein the supporting rack comprises a plate-like planar supporting surface.

13. A supporting rack according to claim 1, wherein the plate-like planar supporting surface includes an array of apertures defined therethrough to allow heat or air passage.

14. A supporting rack according to claim 1, wherein the supporting rack is formed of stainless steel.

15. A supporting rack according to claim 1, wherein the supporting rack is formed of aluminum.

* * * * *